US005472271A

United States Patent [19]

Bowers et al.

[11] Patent Number: 5,472,271

[45] Date of Patent: Dec. 5, 1995

[54] HINGE FOR INSET DOORS

[75] Inventors: Michael J. Bowers, Rockford; Jeffrey L. Sullivan, Loves Park, both of Ill.

[73] Assignee: Newell Operating Company, Freeport, Ill.

[21] Appl. No.: 252,835

[22] Filed: Jun. 2, 1994

Related U.S. Application Data

[62] Division of Ser. No. 52,455, Apr. 26, 1993, Pat. No. 5,355, 559.

[51] Int. Cl.[6] ..... A47B 88/00

[52] U.S. Cl. ..... 312/329; 49/400; 16/391

[58] Field of Search ..... 312/326, 329; 49/399, 400, 401; 16/390, 391, 389

[56] References Cited

U.S. PATENT DOCUMENTS

| | | | |
|---|---|---|---|
| 1,346,867 | 7/1920 | Weibull . | |
| 1,517,205 | 11/1924 | Flagg . | |
| 1,832,845 | 11/1931 | Grimm . | |
| 2,039,614 | 5/1936 | Tinnerman | 49/399 |
| 3,068,508 | 12/1962 | Heyer . | |
| 3,231,928 | 2/1966 | Grunert . | |
| 3,601,428 | 8/1971 | Gilb . | |
| 3,703,742 | 11/1972 | Konishi . | |
| 3,881,221 | 5/1975 | Kiraly | 16/391 |
| 4,291,996 | 9/1981 | Gilb . | |
| 5,004,369 | 4/1991 | Young . | |
| 5,007,200 | 10/1991 | Stowell et al. | 16/390 |
| 5,355,559 | 10/1994 | Bowers | 16/389 |

FOREIGN PATENT DOCUMENTS

| | | | |
|---|---|---|---|
| 0455078 | 7/1913 | France | 16/391 |
| 1421565 | 11/1965 | France | 49/400 |
| 0193120 | 2/1923 | United Kingdom | 16/390 |
| 532788 | 1/1941 | United Kingdom . | |
| 0605291 | 7/1948 | United Kingdom | 16/391 |

*Primary Examiner*—Kenneth J. Dorner
*Assistant Examiner*—Gerald A. Anderson
*Attorney, Agent, or Firm*—Foley & Lardner

[57] ABSTRACT

A hinge for an inset cabinet door includes door and frame wings which enable the door to be adjusted both horizontally and vertically relative to the surrounding face frame of the cabinet. An angled wall of the frame wing enables a locking screw to be driven into the frame at an angle by a power-operated driver without the driver being obstructed by the adjacent side panel of the cabinet.

6 Claims, 4 Drawing Sheets

FIG. 8
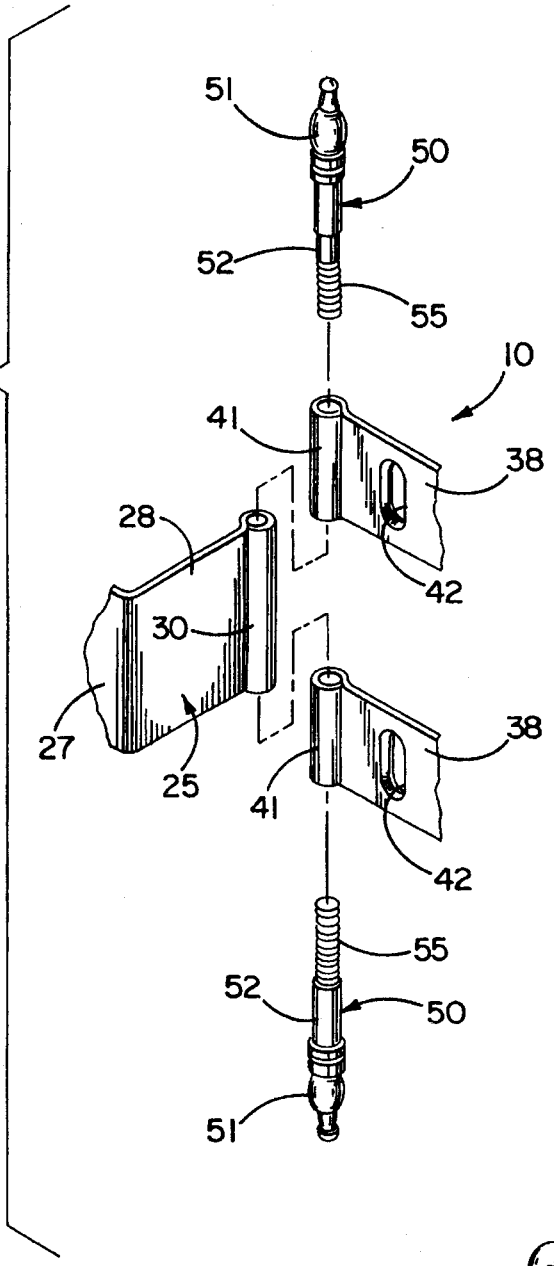
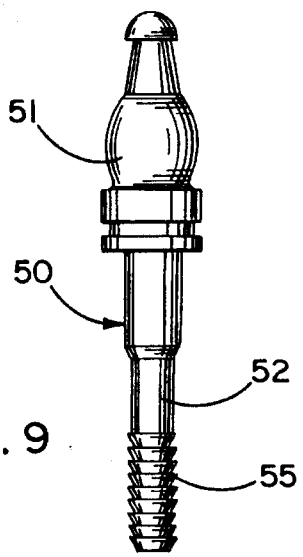
FIG. 9

HINGE FOR INSET DOORS

This is a division of application Ser. No. 08/052,455 filed Apr. 26, 1993, now U.S. Pat. No. 5,355,559.

BACKGROUND OF THE INVENTION

This invention relates generally to a hinge for mounting a substantially rectangular door for swinging between open and closed positions on a cabinet. More specifically, the invention relates to a hinge for mounting a so-called inset door whose periphery is disposed within the periphery of a generally rectangular face frame which extends at right angles to the panels of the cabinet and defines the front opening of the cabinet. When the door is closed, its front side may either be flush with or spaced forwardly from the front side of the face frame.

SUMMARY OF THE INVENTION

The general aim of the present invention is to provide a new and improved inset hinge which may be easily installed and which may be easily adjusted to establish gaps of substantially uniform width between each of the four edges of the door and the adjacent edges of the face frame.

A further object of the invention is to provide a hinge having a frame wing which may be fastened securely to the rear surface of the face frame through the use of a driving tool which may be positioned so as to avoid being obstructed by the adjacent side panel of the cabinet.

Still another object of the invention is to provide a double adjustable inset hinge having elongated fastener-receiving holes which enable the door to be shifted both vertically and laterally to establish gaps of substantially uniform width at all four edges of the door.

The invention also resides in the use of specially configured hinge pins for pivotally interconnecting the door and frame wings.

These and other objects and advantages of the invention will become more apparent from the following detailed description when taken in conjunction with the accompanying drawings.

BRIEF DESCRIPTION OF THE DRAWINGS

FIG. 8 is an exploded perspective view of portions of the hinge.

FIG. 9 is an elevational view of one of the hinge pins.

DETAILED DESCRIPTION OF THE PREFERRED EMBODIMENT

Figure 1:
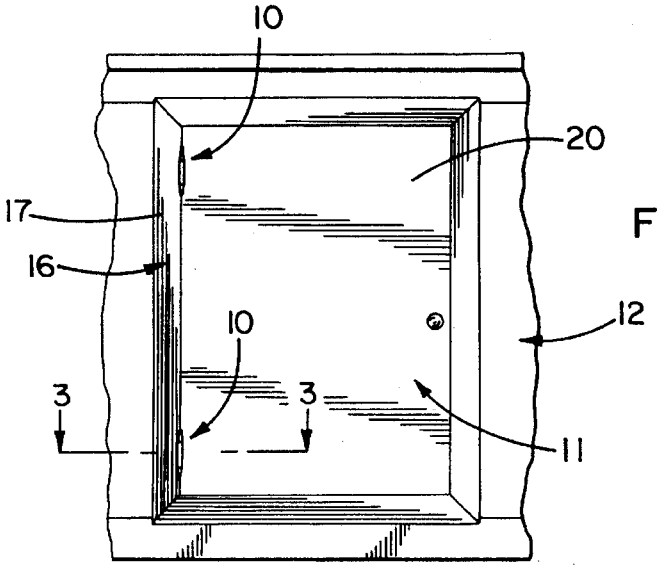
FIG. 1 is a fragmentary front elevational view of a cabinet having a door swingably mounted by new and improved hinges incorporating the unique features of the present invention.

As shown in the drawings for purposes of illustration, the invention is embodied in a hinge 10 for mounting an upright and generally rectangular door 11 for swinging about an upright axis between open and closed positions with respect to a cabinet 12. Typically, the door is mounted by two or more vertically spaced hinges.

Figure 2:
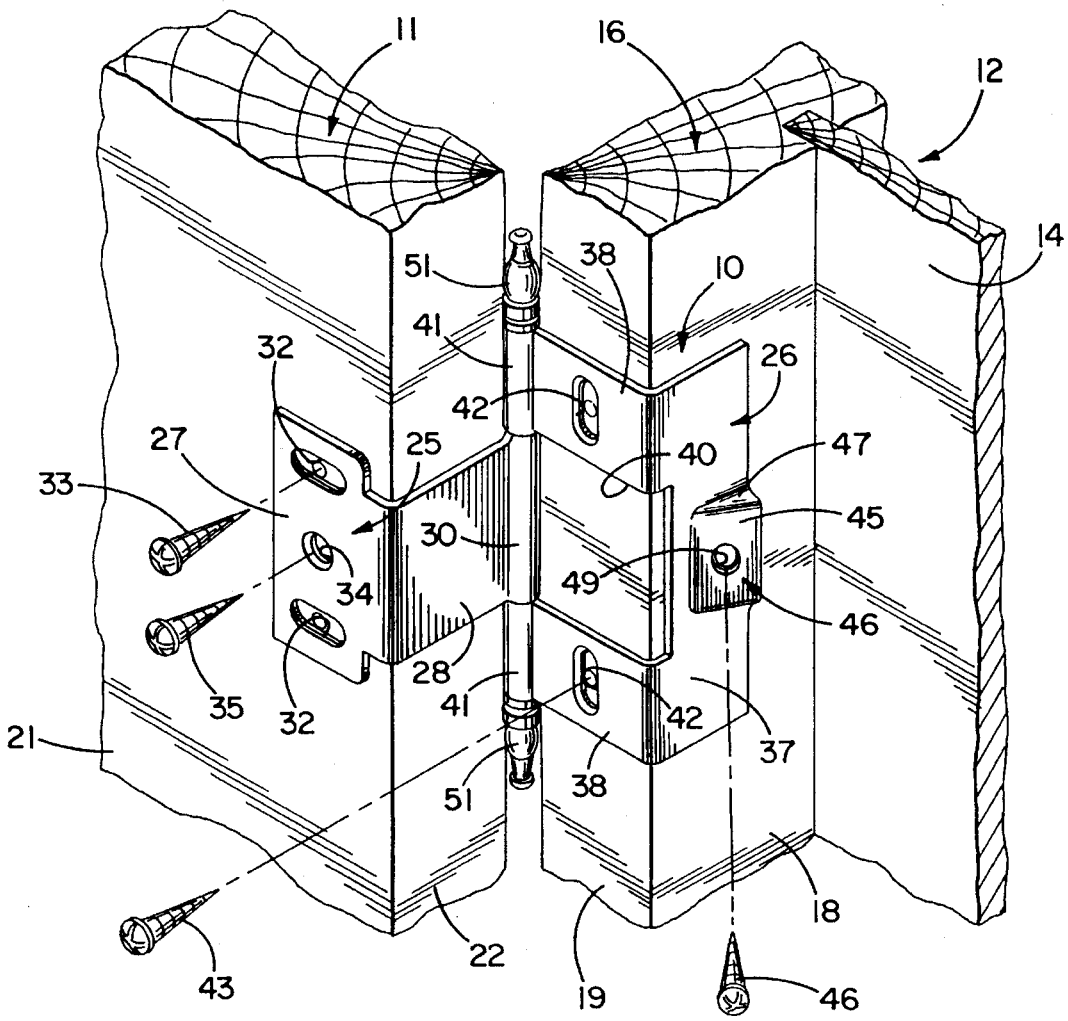
FIG. 2 is an enlarged perspective view showing one of the hinges when the cabinet door is in a fully open position.
Figure 3:
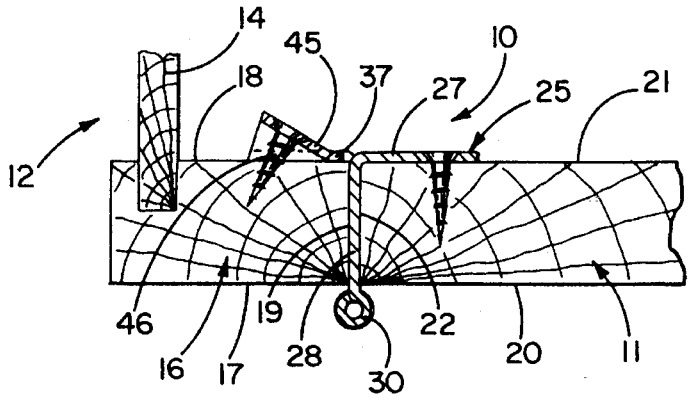
FIG. 3 is an enlarged fragmentary cross-section taken substantially along the line 3—3 of FIG. 1.
Figure 4:
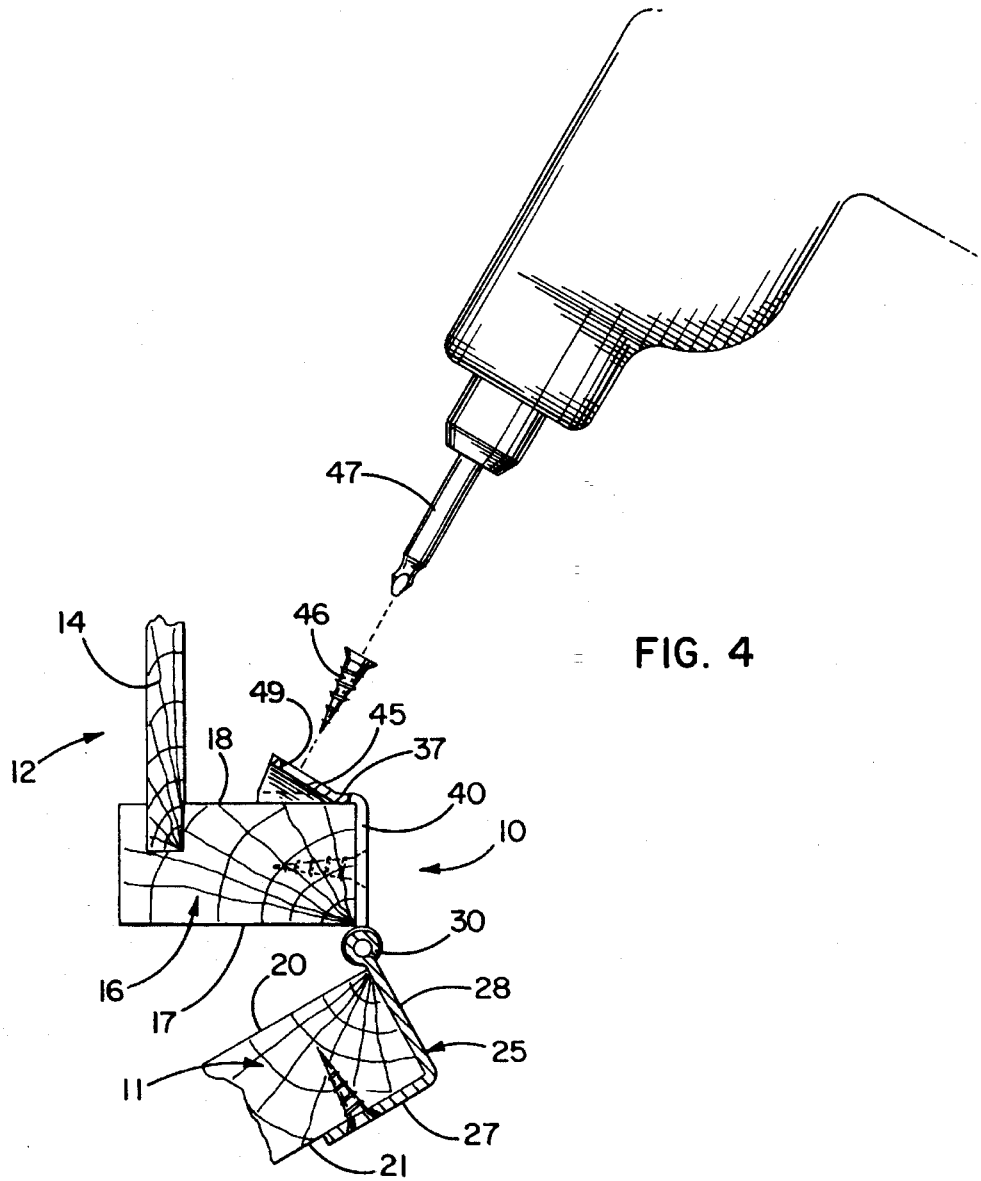
FIG. 4 is a view generally similar to FIG, 3 but shows the door open and shows a locking screw being driven into the frame wing of the hinge.
Figure 5:
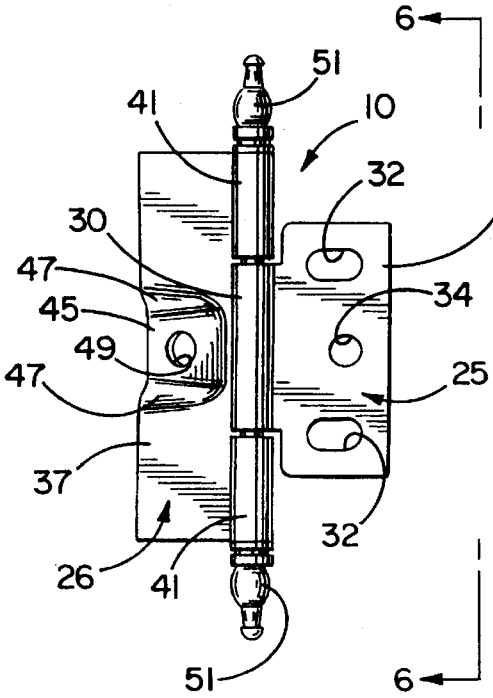
FIG. 5 is a front elevational view of the hinge when the door is in its closed position.
Figure 6:
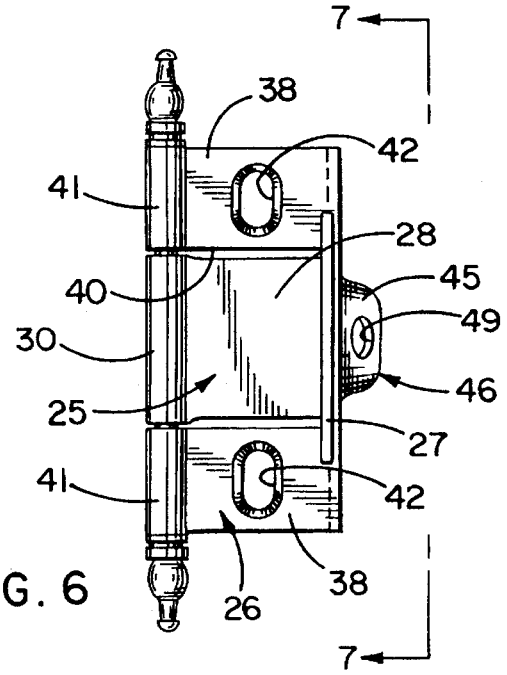
FIG. 6 is an elevational view of the hinge as viewed from the edge surface of the cabinet frame member when the door is in its closed position.

The cabinet 12 includes top, bottom and side panels defining a rectangular storage compartment, one of the upright side panels being designated by the reference numeral 14 (FIGS. 2–4). A face frame with top, bottom and side frame members is attached to the front of the cabinet panels and defines a rectangular access opening at the front of the cabinet 12. One of the side frame members of the face frame has been designated as 16 and is an upright member attached to and extending inwardly at a right angle from the forward end of the side panel 14. The frame member 16 is rectangular in cross-section and includes a forward face surface 17, a rear face surface 18 and an edge surface 19 (FIG. 2) extending perpendicular to the face surfaces.

The door 11 also includes front and rear face surfaces 20 and 21 and edge surfaces 22 extending perpendicular thereto. In this instance, the door is of the inset type and, when closed, all four of its edge surfaces 22 lie within the front opening of the cabinet 12 and are disposed in substantially parallel spaced relation with the edge surfaces 19 of the frame members 16. FIG. 3 shows the door 11 closed with the edge surface 22 of the hinged side of the door in spaced relation with the edge surface 19 of the adjacent frame member 16. When the door is closed, its front face surface 20 usually is flush with the front face surface 17 of the frame member. In more expensive cabinets, however, the front face surface of the door may be offset forwardly a short distance from the front face surface of the frame member.

The present invention contemplates the provision of a unique hinge 10 which enables the inset door 11 to be adjusted in two mutually perpendicular directions relative to the frame member 16 and which enables the hinge to be easily installed without interference from the cabinet side panel 14. Herein, the hinge comprises door and frame wings 25 and 26 adapted to be attached to the door 11 and the frame member 16, respectively, and pivotally interconnected with one another so as to support the door for swinging between its open and closed positions. Each wing preferably is stamped and formed from sheet metal.

The door wing 25 includes a first flange 27 adapted to lie against and engage the rear face surface 21 of the door 11. A second flange 28 is formed integrally with and extends perpendicular to the flange 27 and is adapted to lie alongside the edge surface 22 of the door. The flange 28 has a front-to-rear dimension substantially equal to the thickness of the door and a height somewhat shorter than the flange 27. The flange 28 is centered vertically relative to the flange 27 and its forward free edge portion is formed with a tubular curl 30.

Two vertically spaced and horizontally elongated oblong holes 32 are formed in the flange 27 of the door wing 25 and are adapted to receive fasteners or screws 33 which secure the door wing to the door 11 while permitting the door to be adjusted relative to the door wing. Because of the horizontally elongated holes 32, the screws 33 may be loosened and the door 11 may be shifted horizontally to the left or right relative to the door wing 25 in order to enable gaps of the same width to be established between the left edge surface of the door and the adjacent frame member and between the right edge surface of the door and the adjacent frame member.

A generally circular hole 34 is formed in the flange 27 midway between the holes 32 and is adapted to receive a locking screw 35 for rigidly clamping the door wing 25 in a fixed position on the door 11 once the door wing and the door have been relatively adjusted to a proper location.

The frame wing 26 also includes a flange 37 and flange means 38 formed integrally with and extending at right angles to the flange 37. The flange 37 lies along and engages the rear face surface 18 of the frame member 16 while the flange means 38 lie along and engage the edge surface 19 of the frame member. A generally rectangular opening or window 40 is formed in the flange means 38 midway along the height thereof and, when the door 11 is fully closed, is capable of completely receiving the flange 28 of the door wing 25 so that only one thickness of sheet metal exists in the gap between the two edge surfaces 19 and 22. Because of the window 40, the flange means 38 actually appears as a pair of upper and lower webs. Upper and lower tubular curls 41 are formed at the forward free edges of the webs 38. When the hinge is assembled, the curl 30 on the flange 28 is located between the curls 41. Hinge pin means which will be described subsequently pivotally interconnect the curl 30 with the curls 41 so as to support the door wing 25 for swinging relative to the frame wing 26.

As shown most clearly in FIG. 2, vertically spaced and vertically elongated oblong holes 42 are formed through the webs 38 of the frame wing 26 and are adapted to receive screws 43 which secure the frame wing to the frame member 16 while permitting the frame wing to be adjusted vertically relative to the frame member. By virtue of the vertically elongated holes 42, the screws 43 may be loosened to enable the door 11 to be shifted vertically as necessary to establish gaps of substantially uniform width between the upper edge of the door and the top frame member and between the lower edge of the door and the bottom frame member.

Once the frame wing 26 has been adjusted vertically to the proper position on the frame member 16, it is necessary to lock the frame wing rigidly in place. Pursuant to the invention, the flange 37 of the frame wing is formed with an angled wall 45 which permits driving of an anchoring screw 46 by a power-operated driver 47 (FIG. 4) without the driver being encumbered or obstructed by the side panel 14 of the cabinet 12.

Figure 7:
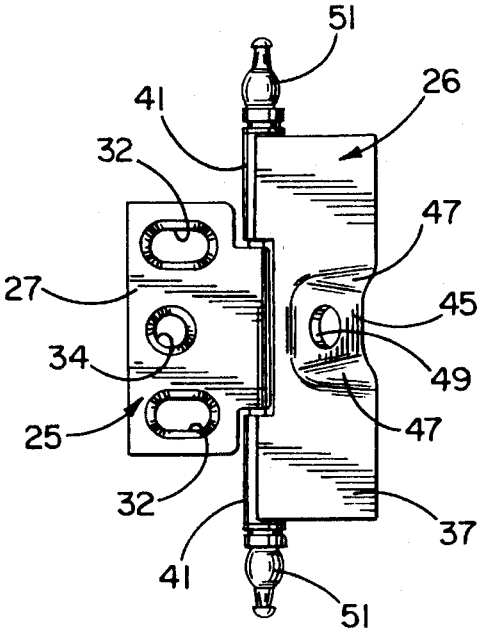
FIG. 7 is a rear elevational view of the hinge when the door is in its closed position.

More specifically, the angled wall 45 is part of a boss 46 which is created by rearwardly deforming a portion of the flange 37 midway along the height of the flange. The wall 45 is disposed in an upright plane and is angled so that it diverges away from the rear face surface 18 of the frame member 16 as it progresses away from the edge surface 19 of the frame member. In this instance, the angle of divergence is approximately thirty degrees. The angled wall 45 is connected to the flange 37 by upper and lower generally triangular webs 47 (FIGS. 2 and 7) which, together with the wall, define the boss 46.

A generally circular hole 49 is formed through the wall 45 for receiving the screw 46. Herein, the axis of the hole is disposed perpendicular to the wall and thus is inclined at an angle of about sixty degrees relative to the rear face surface 18 of the frame member 16 and at an angle of about thirty degrees relative to the side panel 14.

With the foregoing arrangement, the locking screw 46 may be positioned at an substantial angle relative to the side panel 14 and inserted into the hole 46. As a result, the power-operated driving tool 47 may be angled to drive the screw into the frame member 16 without the tool or its driver being obstructed by the side panel as otherwise would be the case if the axis of the hole were parallel to the side panel.

By virtue of forming the hole 49 for the locking screw 46 in the wall 45 of the flange 37, the flange 38 need not be provided with a locking screw hole and thus may be formed with the window 40 for receiving the flange 28 of the door wing 25. As pointed out above, this results in only one thickness of sheet metal in the gap between the edge surfaces 19 and 22 and thus that gap may be of narrow width.

In this instance, the door and frame wings 25 and 26 are connected by upper and lower identical hinge pins 50 (FIG. 8). Each pin is formed with an enlarged head 51 and an elongated shank 52. The shank of the upper pin extends loosely through the upper curl 41 of the frame wing 26 and is received with a press fit in the curl 30 of the door wing 25. Similarly, the shank of the lower pin extends loosely through the lower curl 41 of the frame wing and is received with a press fit in the curl 30 of the door wing. When the pins are pressed into place, the heads 51 of the upper and lower pins clamp against the upper and lower ends, respectively, of the upper and lower curls 41 and cause those curls to move vertically into engagement with the curl 30 so as to take up any gaps between the curl 30 and the curls 41.

Advantageously, the end portion of each shank 52 that is received in the curl 30 is serrated as indicated at 55 (FIGS. 8 and 9) so as to enhance the press fit between the shank and the curl and thereby decrease the tendency of the pin 50 to shift axially. This keeps the heads 51 of the pins clamped against the curls 41 and keeps those curls tight against the curl 30 in order to prevent vertical gaps from developing between the curls. The serrations 55 may be provided by knurling the shanks, by forming longitudinally extending ribs and grooves along the shanks or by forming the shanks with a series of frustums as shown most clearly in FIG. 9.

From the foregoing, it will be apparent that the present invention brings to the art a new and improved hinge 10 for an inset door 11. The hinge enables the door to be adjusted from left-to-right by virtue of the horizontally elongated holes 32 in the flange 27 and enables the door to be adjusted upwardly and downwardly by virtue of the vertically elongated holes 42 in the flange means 38. The angled wall 45 enables the locking screw 46 to be driven by the driver 47 without interference from the side panel 14 and enables the flange means 38 to be formed with the window 40 for receiving the flange 28.

We claim:

1. The combination of, a cabinet having an upright side panel, having an upright face frame member extending generally perpendicular from the side panel and defining part of an access opening, having an upright door member, and having a hinge for mounting the door member for swinging between open and closed positions on the frame member, each of said members comprising a rear upright face surface and each further comprising an upright edge surface extending generally perpendicular to the face surface, the edge surface of said door member being inset from and being disposed in substantially parallel relation with the edge surface of said frame member when said door member is in said closed position, said hinge comprising a door wing having first and second flanges engageable with said rear face surface and said edge surface, respectively, of said door member, horizontally elongated holes formed through said first flange of said door wing, fasteners extending through said holes and securing said door wing to said door member, said hinge further comprising a frame wing having first and second flanges engageable with said rear face surface and said edge surface, respectively, of said frame member, vertically elongated holes formed through the second flange of said frame wing, fasteners extending through said vertically elongated holes and securing said frame wing to said frame member, means pivotally interconnecting said second flanges of said door and frame wings and supporting said door member for swinging between said positions, and an opening in the second flange of said frame wing and receiving substantially all of the second flange of said door wing when said door member is in said closed position.

2. The combination defined in claim 1 in which said hinge includes an upright wall formed integrally with and projecting rearwardly from said first flange of said frame wing and angled in such a direction as to diverge away from the rear face surface of said frame member upon progressing away from the edge surface of said frame member, and a fastener-receiving hole formed through said wall and having an axis disposed substantially perpendicular to said wall.

3. The combination defined in claim 1 in which said second flange of said frame wing includes upper and lower vertically spaced curls, the second flange of said door wing including a center curl located between said upper and lower curls, said means comprising upper and lower hinge pins each having a head and a shank, the head of said upper pin engaging the upper end of said upper curl, the shank of said upper pin including a first portion extending loosely through said upper curl and a second portion extending into said center curl with a press fit, the head of said lower pin engaging the lower end of said lower curl, the shank of said lower pin including a first portion extending loosely through said lower curl and a second portion extending into said center curl with a press fit, the second portions of said shanks being serrated to enhance the press fit between said shanks and second center curl and to keep the heads of said pins in engagement with the ends of said upper and lower curls.

4. The combination defined in claim 1 further including a generally circular hole formed through said first flange of said frame member, and a fastener extending through said generally circular hole and anchoring said frame wing to said frame member.

5. The combination defined in claim 4 in which said generally circular hole is located at an elevation between the elevations of said vertically elongated holes.

6. The combination defined in claim 5 further including a generally circular hole extending through said second flange of said door wing and located between said horizontally elongated holes, and a fastener extending through said generally circular hole of said door wing and anchoring said door wing to said door member.

* * * * *